United States Patent [19]

Suzuki

[11] Patent Number: 4,957,030

[45] Date of Patent: Sep. 18, 1990

[54] ELECTRONIC MUSICAL INSTRUMENT HAVING A VIBRATO EFFECTING CAPABILITY

[75] Inventor: Isao Suzuki, Toyohashi, Japan

[73] Assignee: Kawai Musical Instruments Mfg. Co., Ltd., Japan

[21] Appl. No.: 355,555

[22] Filed: May 23, 1989

[30] Foreign Application Priority Data

May 26, 1988 [JP] Japan ..... 63-129066

[51] Int. Cl.[5] ..... G10H 1/02; G10H 7/06

[52] U.S. Cl. ..... 84/604; 84/629

[58] Field of Search ..... 84/604–607, 84/629; 381/62

[56] References Cited

U.S. PATENT DOCUMENTS

| | | | |
|---|---|---|---|
| 4,026,180 | 5/1977 | Tomisawa et al. | 84/629 |
| 4,099,438 | 7/1978 | Hiyoshi et al. | 84/629 |
| 4,342,245 | 8/1982 | Gross | 84/604 |
| 4,419,919 | 12/1983 | Kashio | 84/629 X |
| 4,476,765 | 10/1984 | Hentzschel et al. | 84/604 |
| 4,539,885 | 9/1985 | Ezawa | 84/629 X |
| 4,569,268 | 2/1986 | Futamase et al. | 84/629 X |
| 4,656,428 | 4/1987 | Ishikawa | 84/604 X |
| 4,785,702 | 11/1988 | Katoh | 84/604 |
| 4,893,538 | 1/1990 | Masaki et al. | 84/605 |
| 4,920,851 | 5/1990 | Abe | 84/629 |

*Primary Examiner*—W. B. Perkey

*Attorney, Agent, or Firm*—Koppel & Jacobs

[57] ABSTRACT

An electronic musical instrument capable of effecting vibratos with any of tones which may be produced by pressing down the keys of a keyboard. A key constant memory stores key constants each being assigned to a different tone, while a vibrato constant memory stores vibrato constants each being assigned to a different tone. The keyboard is provided with an exclusive switch for effecting vibratos. When this exclusive switch is pressed, a counter which counts clock pulses feeds its output to an adder/subtractor in the form of an addition/subtraction switchover signal and an addition/subtraction execution control signal. In response, the adder/subtractor periodically and alternately performs addition and subtraction with the key constant and vibrato constant associated with a key being pressed down.

1 Claim, 6 Drawing Sheets

| TONE | KEY CONSTANT K | VIBRATO CONSTANT V(f) |
|---|---|---|
| $C_4$ | 4.0186 | 0.0093 |
| $A_4$ | 6.7585 | 0.0157 |
| $C_5$ | 8.0372 | 0.0186 |

ELECTRONIC MUSICAL INSTRUMENT HAVING A VIBRATO EFFECTING CAPABILITY

BACKGROUND OF THE INVENTION

The present invention relates to an electronic piano or similar electronic musical instrument having a capability of effecting vibratos with a desired tone which is produced by pressing down a key provided on a keyboard.

An electronic musical instrument such as an electronic piano has heretofore been proposed in various forms, as disclosed in Japanese Laid-Open Patent Publication (Kokai) No. 48-34523 by way of example. A prior art instrument of this kind includes a keyboard, a key detector for detecting a key on the keyboard 12 which is pressed down, a key constant memory loaded with key constants each being associated with a different tone which may be produced by pressing a particular key, an address signal generator for generating an address signal by effecting an arithmetic operation with any of the key constants at a predetermined period, a tone waveform memory storing the amplitudes of a tone waveform associated with various sampling points in the form of digital values, a digital-to-analog (DA) converter for sequentially converting into analog values the digital amplitudes which are associated with the individual sampling points and read out of the tone waveform memory to thereby produce a tone signal. Various approaches have also been proposed for providing such an instrument with a vibrato effecting capability, as shown and described in Japanese Patent Publication No. 57-22399, for example. Specifically, to effect vibratos with a certain tone, the frequency f of the tone is oscillated up and down. Concerning a tone $C_4$, for example, the frequency f of 261.626 hertz may be repetitively varied over a range of $\pm 10$ hertz once per a specific period such as 5 hertz. The range of $\pm 10$ hertz may be increased to render the vibrato stronger or decreased to render it weaker. For the same width of $\pm 10$ hertz, the vibrato effect achievable differs from, for example, the vibrato frequency of about 5 hertz to the vibrator frequency of about 10 hertz. Assuming the tone $C_4$ whose frequency is 261.626 hertz and the vibrato frequency of 5 hertz, a vibrato effect is achievable by sequentially varying the frequency as 261.626 hertz, 271.626 hertz, 261.626 hertz, 251.626 hertz, 261.626 hertz and so forth. Then, a different vibrator effect will be produced if the vibrato frequency is changed from 5 hertz to 10 hertz with the transitions of frequency of the tone $C_4$ being maintained the same. In this manner, the vibrato effect for a given tone depends on the width over which the frequency of the tone is increased and decreased once from the center frequency and, also, on the vibrato frequency. More specifically, when a certain key on the keyboard is pressed down, a tone associated with the key has its center frequency increased and decreased over a predetermined frequency width during a predetermined period thereof.

The prior art instrument described above is provided a multiplier for multiplying an output signal of the key constant memory and a control signal fed from a vibrato controller. The rate of generating address signals for reading the amplitudes associated with the individual sampling points out of the tone waveform memory, i.e., the output timing is controlled on the basis of the output of the multiplier.

A drawback with such an instrument heretofore proposed is that the multiplier and vibrato controller are extremely complicated in construction. Furthermore, when the instrument is controlled by a computer, not only a substantial period of time is needed for the processing but also a microprocessor of the computer has to bear an extra load.

SUMMARY OF THE INVENTION

It is therefore an object of the present invention to eliminate the drawbacks particular to the prior art electronic musical instrument as discussed above.

It is another object of the present invention to provide a simple and inexpensive electronic musical instrument capable of providing a tone with vibratos.

It is another object of the present invention to provide an electronic musical instrument having a vibrato effecting capability which can be readily implemented by a small-scale microprocessor while promoting rapid processing.

It is another object of the present invention to provide a generally improved electronic musical instrument having a vibrato effecting capability.

An electronic musical instrument capable of effecting vibratos with a tone being produced of the present invention comprises a keyboard having a vibrato switch, a key detector for detecting a key on the keyboard which is pressed down, a key constant memory storing predetermined key constants each being associated with respective one of tones which may be produced by the instrument, an address signal generator for generating an address signal by performing, every predetermined period of time, an arithmetic operation with the key constant associated with the key which is pressed, a tone waveform memory storing amplitudes of a tone waveform each being associated with respective one of a plurality of sampling points, in the form of digital values, a DA converter for sequentially converting the digital amplitudes read out of the tone waveform memory in response to the address signals into an analog tone signal, a counter for counting clock pulses which begin to appear when a power supply of the instrument is turned on, a vibrato constant memory storing vibrato constant each being associated with respective one of the keys on the keyboard, and an adder/subtractor for, when the vibrato switch is pressed, periodically performing addition and subtraction with the key constant and vibrato constant in response to an addition/subtraction switchover signal and an addition/subtraction execution control signal which are constituted by an output of the counter.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
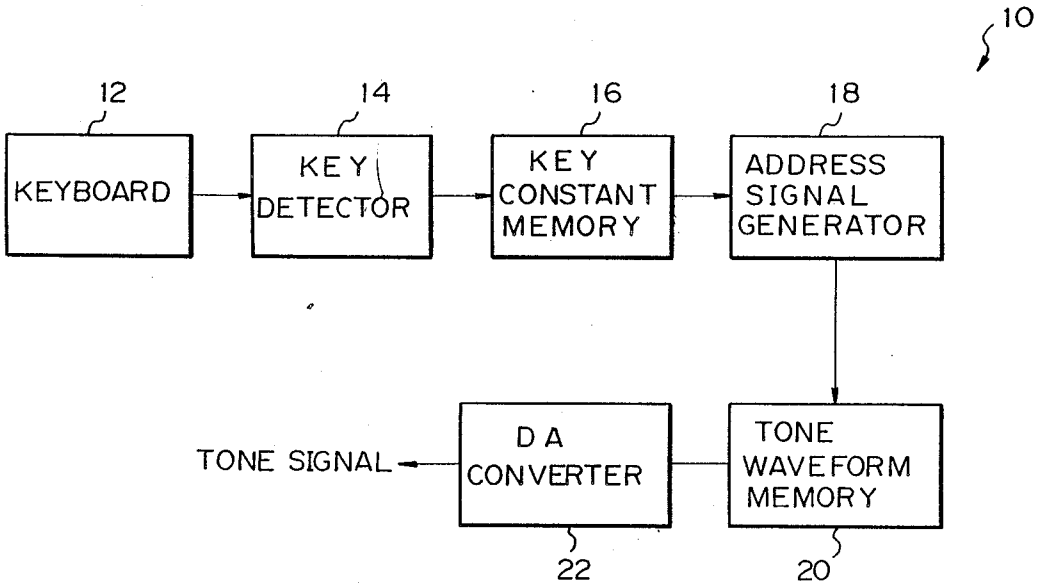
Fig. 1 PRIOR ART
FIG. 1 is a schematic block diagram showing a prior art electronic musical instrument.

To better understand the present invention, a reference will be made to a prior art electronic musical instrument, shown in FIG. 1. As shown, the instrument, generally 10, includes a keyboard 12 having multiple keys (not shown) arranged thereon, a key detector 14 for detecting a key on the keyboard 12 which is pressed down. A key constant memory 16 stores key constants each being associated with a different tone which may be produced by manipulating the keyboard 12. An address signal generator 18 generates an address signal by performing an arithmetic operation with a key constant every predetermined period of time. A tone waveform memory 20 stores the amplitudes of a tone waveform at various sampling points in the form of digital values. A DA converter 22 sequentially converts into analog values the digital amplitudes which are associated with the individual sampling points and read out of the tone waveform memory 20, thereby producing a tone signal. The tone waveform memory 20 is usually implemented by a ROM (Read Only Memory) and stores, in the form of digital values and positive and negative signs, the amplitudes of a tone waveform to be reproduced and which are determined at n sampling points. While the amplitudes may be represented by differences and positive and negative signs, the following description will concentrate on the digital values and signs by way of example.

Figures 2, 4:
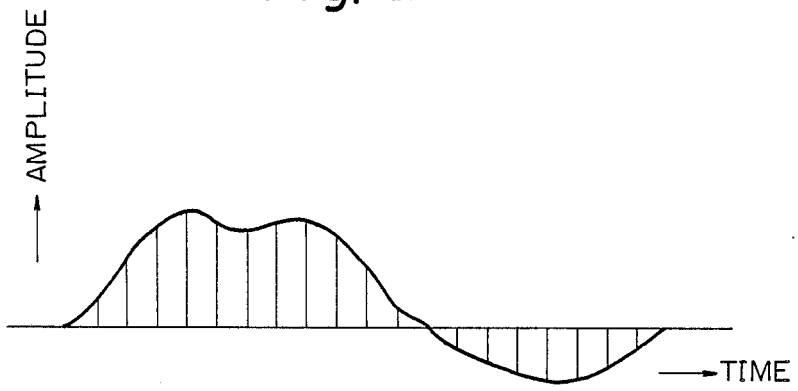
FIG. 2 plots a relationship between the amplitudes at various sampling points and the addresses with respect to the waveform of a tone which may be produced by the instrument of FIG. 1.
FIG. 4 lists specific numerical values of key constants K and vibrato constants V (f) which are stored respectively in a key constant memory and a vibrato constant memory shown in FIG. 3.

FIG. 2 plots a relationship between the amplitudes at various sampling points and the addresses with respect to a tone waveform which is produced by pressing a key on the keyboard 12. To reproduce the analog waveform shown in the figure, one period (one cycle) is divided into n segments at equal intervals along the time axis, and the amplitudes at the respective sampling points are stored in the consecutive addresses of the tone waveform memory 20 in the form of digital values. The value n may be 32, 64 or 128, for example. By increasing the number of such sampling points per period, it is possible to reproduce a tone waveform which is quite approximate to the analog waveform shown in FIG. 2. Concerning the waveform of FIG. 2, for example, when the rate of reading 128 sampling points (addresses), i.e., the rate of generating address signals is changed in association with the frequency of a tone, the waveform of a tone (period) associated with a particular key pressed will be outputted. When the sampling points are individually associated with consecutive addresses of "0" to "127", an address counter will be implemented as a cyclic counter which is reset every time "128" is reached. By driving the address counter by clock pulses, for example, and feeding its outputs to the tone waveform memory 20 as address signals, the instrument 10 is capable of reproducing a tone waveform as shown in FIG. 2.

To control the rate of address signal generation, the key constant memory 16 is loaded with predetermined constants (hereinafter referred to as key constants K) each being associated with a different tone. The key constants K are sequentially added at each predetermined interval (hereinafter referred to as an operation period t) which is the same for all of the tones. When the sum (integer) reaches a value which designates the next address, it is outputted as an address signal for reading data out of the tone waveform memory 20. When the sum is short of the next address, the key constants K are simply added. The key constant K is a function proportional to the operation period t, the number of sampling points n, and the frequency f of a tone, and it may be represented by a product of those factors, as follows:

$$K = t \times n \times f \qquad \text{Eq. (1)}$$

It is to be noted that a tone waveform generally has an operation period t which is of the microsecond order. Concerning a tone $C_4$, for example, the frequency f is 261.626 hertz and, therefore, one period is about 3,822.2 microseconds. Assuming that the number of sampling points n is 128, when a key on keyboard 12 which is associated with the tone $C_4$ is pressed, the address signal will be produced at the interval of 3,822.2/128 (microseconds)=29.86 (microseconds). The address signals to be generated at such intervals are determined by arithmetic operation on the basis of the key constant K. For this purpose, the key constant K is read out of the key constant memory 14 in response to clock pulses which appear at every operation period t, and is sequentially added. Hence, the key constants K usually have values below the decimal point. The smaller the key constants K and the shorter the calculation period t, the higher the accuracy becomes.

As stated above, reading out the key constants K associated with the individual keys in response to a clock having a predetermined period and sequentially adding them is successful in generating address signals at rates each matching a different tone. Summarizing the above procedure, the amplitudes of a tone waveform determined at n sampling points as shown in FIG. 2 are read out in response to address signals which are calculated and produced at the rates associated with depressed keys, whereby digital waveforms matching the individual keys are achievable.

With the prior art electronic instrument 10, it is possible to effect vibratos with any tone having a frequency f only if the frequency is oscillated up and down away from the center frequency f. Concerning the previously mentioned tone $C_4$, for example, the frequency f of 261.626 hertz may be repetitively varied over a range of ±10 hertz may be increased to render the vibratos stronger or decreased to render it weaker. For the same width of ±10 hertz, the vibrato effect achievable differs from, for example, the vibrato frequency of about 5 hertz to the vibrator frequency of about 10 hertz. Assuming the tone $C_4$ whose frequency is 261.626 hertz and the vibrato frequency of 5 hertz, a vibrato effect is achievable by sequentially varying the frequency as 261.626 hertz, 271.626 hertz, 261.626 hertz, 251.626 hertz, 261.626 hertz and so forth. Then, a different vibrato effect will be produced if the vibrato frequency is changed from 5 hertz to 10 hertz with the transitions of frequency of the tone $C_4$ being matained the same. In this manner, the vibrato effect for a given tone depends on the width over which the frequency of the tone is increased and decreased once from the center frequency and, also, on the vibrato frequency. More specifically, when a certain key on the keyboard 12 is pressed down, a tone associated with the key has its center frequency increased and decreased over a predetermined width during a predetermined period thereof.

The prior art electronic instrument 10 having the above construction and arrangement has some problems left unsolved, as discussed earlier.

Figure 3:
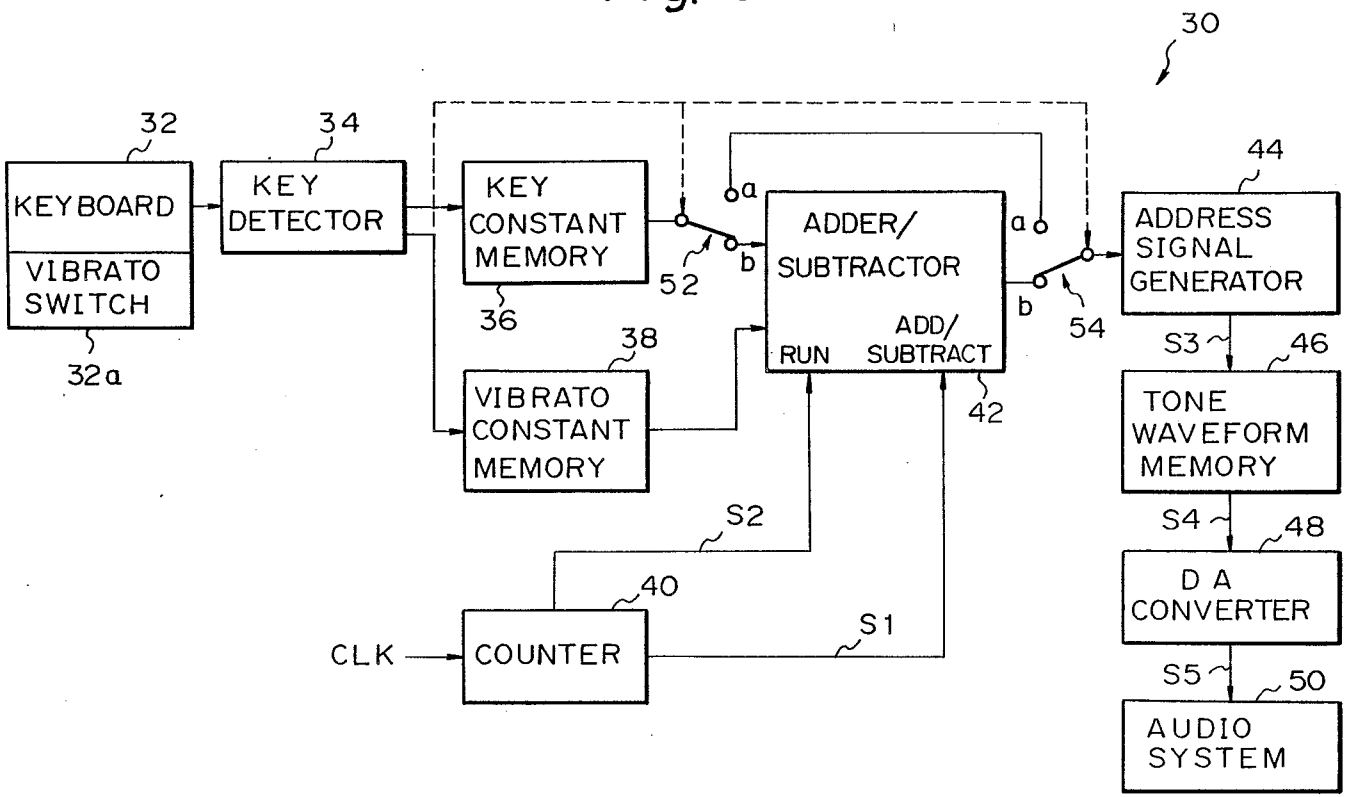
FIG. 3 is a schematic block diagram of an electronic musical instrument embodying the present invention.

Referring to FIG. 3, an electronic musical instrument embodying the present invention is shown and generally designated by the reference numeral 30. As shown, the instrument 30 includes a keyboard 32 which is provided with an exclusive switch **32*a* for effecting vibratos. The instrument 30 further includes a key detector 34 responsive to a key on the keyboard 32 being depressed, a key constant memory 36, a vibrato constant memory 38, a counter 40, an adder/subtractor 42, an address signal generator 44, a tone waveform memory 46, a DA converter 48, an audio system 50, and switches 52 and 54. The vibrato switch 32*a* and the switches 52 and 53 are operatively associated with each other, as described in detail later. Among the various units shown in FIG. 3, the vibrato constant memory 38, counter 40 and adder/subtractor 42 are the major components which contribute to the vibrato effect. The rest of the construction and arrangement is substantially the same as in the prior art instrument 10 shown in FIG. 1**.

The instrument 30 is of course operated in the same manner as the prior art instrument 10 except for a vibrato mode. In a usual operation mode, when any of the keys on the keyboard 32 is pressed down, the key detector 34 determines which of the keys is depressed. Then, the key detector 34 delivers a key code assigned to the pressed key to the key constant memory 36 in order to read out a particular key constant K associated with a tone which is to be produced by the pressed key. FIG. 4 lists some specific numerical values representative of key constants K stored in the key constant memory 36 and vibrato constants V (f) stored in the vibrato constant memory 38. The key constant K is a function proportional to the operation period t, the number of sampling points n, and the frequency f of a tone and is produced as a sum of such factors, as represented by the Eq. (1). The key constants K and the vibrato constants V (f) shown in FIG. 4 pertain to a case wherein the operation frequency t is 120 microsecond and the number of sampling points n is 128. As FIG. 4 indicates, the tone $C_4$ whose frequency f is 261.626 hertz is provided with a key constant K of 4.0186 as calculated by using the Eq. (1). Likewise, a tone $A_4$ whose frequency f is 440.000 hertz is provided with a key constant of 6.7585 while a tone $C_5$ having a frequency f of 523.251 hertz is provided with a key constant of 8.0372. Concerning the vibrato constant V (f), in the case that a vibrato of ±10 cents is effected by 10 times of calculation, 4 cents are added to the center frequency f, as represented by:

$$V(f)=K(f+4\text{ cents})-K(f) \qquad \text{Eq. (2)}$$

Figure 5:
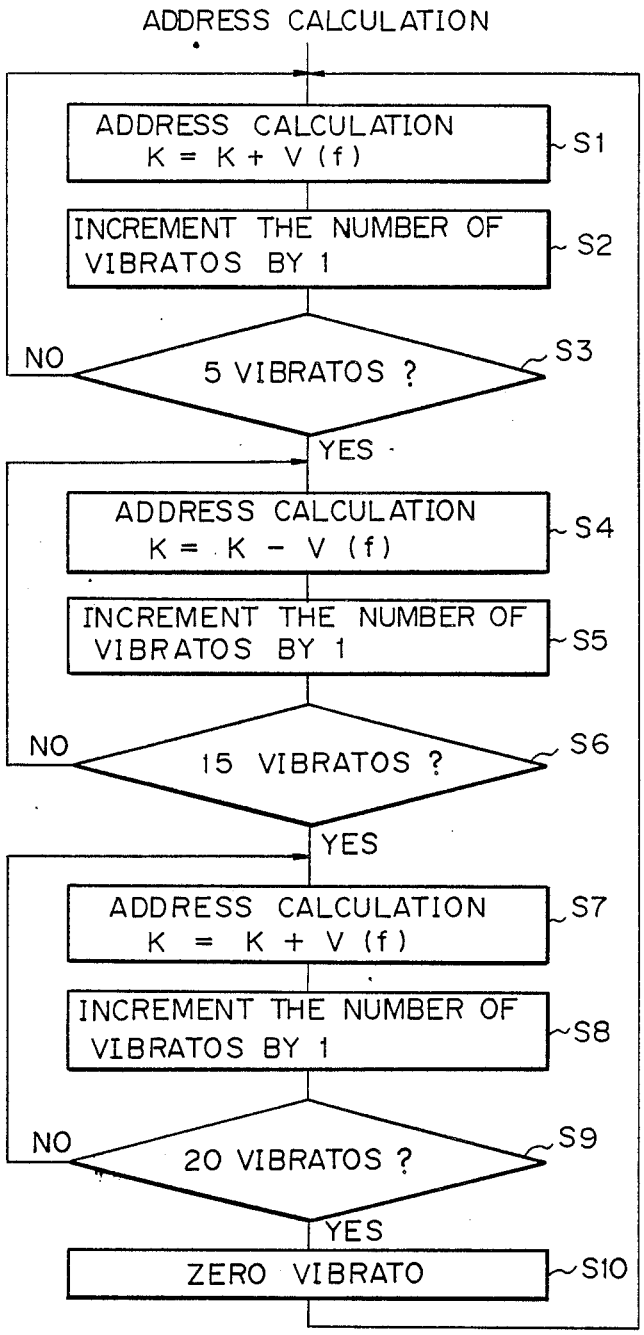
FIG. 5 is a flowchart demonstrating a specific sequence of steps for calculating an address by using a key constant K and a vibrato constant V (f)

Referring to FIG. 5, there is shown a sequence of steps for determing an address by executing arithmetic operations with a key constant K and a vibrato constant V (f). In the figure, the consecutive steps are idividually labeled S1 to S10. The counter 40 counts clock pulses CLK which are continuously applied thereto from the instant when the power supply of the system is turned on. The output of the counter 40 is used as a signal S1 for switching over the adder/subtractor 42 with respect to the function and as a control signal S2 for executing addition or subtraction. The output of the adder/subtractor 42 is fed to the address signal generator 44. In response, the address signal generator 44 generates an address signal S3 by correcting the key constant K by the vibrato constant V (f).

The above operation will be described more specifically taking the tone $A_4$ as an example. The tone $A_4$ has a frequency f of 440 hertz and a key constant K of 6.758 (decimal number) as produced by the Eq. (1). Assume that the frequency f is to be varied over a range of −20 cents to +20 cents by ten times of calculations. Then, the frequency f needs only to be changed by 4 cents for each arithmetic operation. It is to be noted that twenty times of operations are executed per period of vibratos. Adding 4 cents to the frequency of 440 hertz results 441.018 hertz. The key constant K of the frequency 440 hertz is 6.758 (decimal number) as produced by the Eq. (1). In this case, assuming that the vibrato frequency is 6 hertz, one period is 166.6 milliseconds and, during this period of time, twenty consecutive times of operations are performed. Hence, one arithmetic operation completes in 166.6/20 milliseconds, i.e. 8.33 milliseconds. In order that the tone $A_4$ may be changed by 4 cents every 8.33 milliseconds, a vibrato constant V (f) of 0.016 (decimal number) suffices as produced by the Eq. (2).

Figure 6:
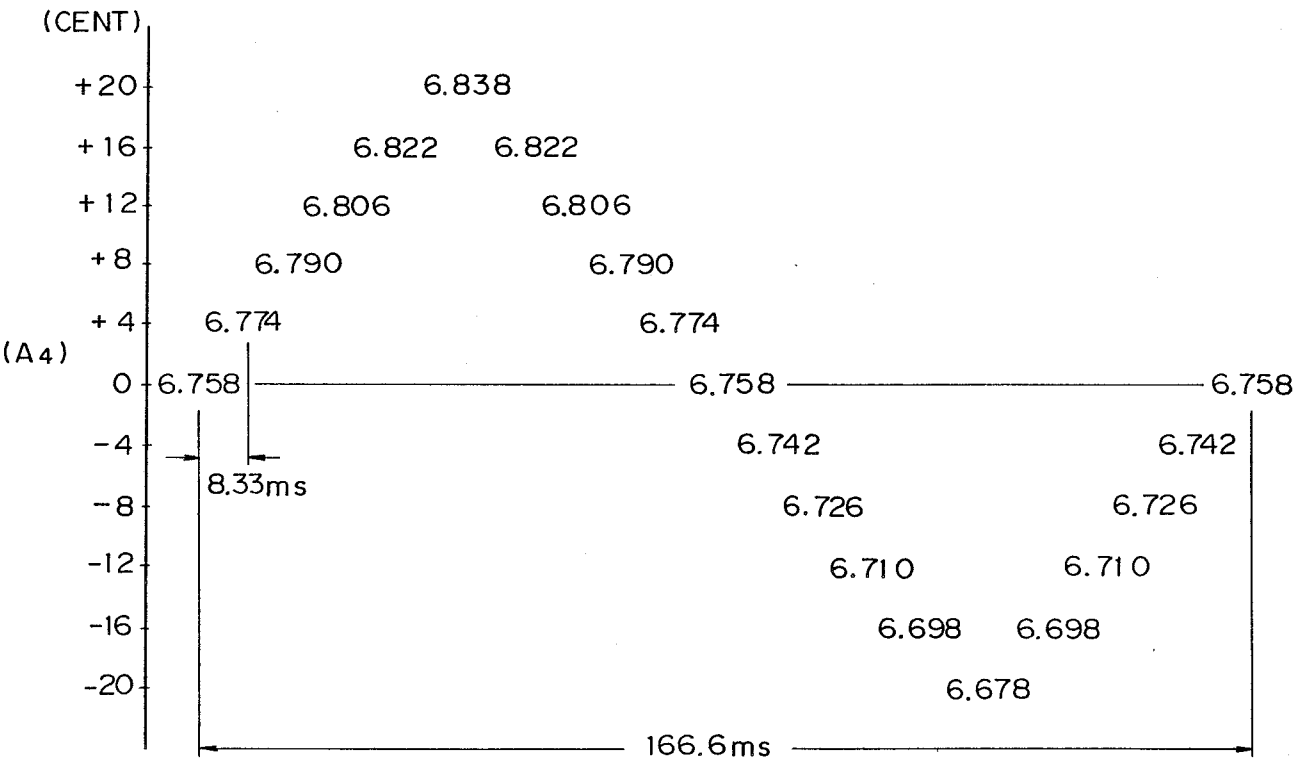
FIG. 6 plots, with respect to time, the variation of a key constant associated with a tone $A_4$ having a frequency of 440 hertz and which is changed by each 4 cents over ±20 cents in total.

FIG. 6 plots a specific relationship between the key constant K and the time obtainable with the instrument 30 with respect to a case wherein the tone $A_4$ whose frequency is 440 hertz is varied over ±20 cents in total by every 4 cents. As shown, a vibrato constant V (f) of 0.016 is added to the key constant K of 6.758 (decimal number) of the tone $A_4$ every 8.33 milliseconds which is the one calculation time, thereby correcting the key constant. When m reaches 5, i.e., when the key constant is corrected up to 6.838, the vibrato constant V (f) begins to be subtracted from the key constant K. This subtraction is repeated ten times, i.e. 2 m=10. As a result, the key constant K is sequentially varied as 6.838, 6.822, 6.806, . . . , 6.710, 6.698 and 6.678 in this order, as shown in FIG. 6. In this manner, the vibrato constant V (f) is subtracted ten consecutive times from the key constant K and, as the corrected key constant K of 6.678 is reached, the frequency of the tone $A_4$ with a vibrato becomes lowest. Thereupon, the vibrato constant V (f) is again added to the corrected key constant K to sequentially increase the key constant K as 6.678, 6.698, 6.710, . . . , 6.758, . . . , 6.774, 6.790, . . . , 6.838 in this order.

As stated above, the key constant K of the tone $A_4$ is sequentially corrected by the addition and subtraction of the vibrato constant V (f) which is associated with 4 cents. When the vibrato frequency is 6 hertz, the arithmetic operation is performed twenty consecutive times per period of the vibrato frequency, i.e. 166.6 milliseconds. It follows that the frequency of the tone $A_4$ which is 440 hertz is sequentially incremented by 4 cents per 8.33 milliseconds and, on reaching 20 cents, sequentially decremented by each 4 cents, i.e., the frequency increases from 440 hertz to 445.090 hertz (+20 cents) and then decreases to 434.610 hertz (−20 cents). Such a frequency variation is achievable by controlling the stepping rate of the address signal as with the prior art electronic musical instrument.

When the vibrato switch 32a shown in FIG. 3 is pressed to in turn connect the switches 52 and 54 to terminals b, the adder/subtractor 42 performs addition and subtraction with the key constant K and vibrato constant V (f) as discussed above with reference to the flowchart of FIG. 5, while delivering the resulting output to the address signal generator 44. Therefore, the stepping rate of the address signal is increased for the transition of frequency from 440 hertz to 445.090 hertz (+20 cents), for example, and is decreased for the transition from 445.090 hertz to 434.610 hertz (−20 cents), whereby a vibrato resembling ±20 cents is effected.

In an alternative embodiment of the present invention, a counter is provided for counting clock pulses which begin to appear as soon as the power supply of the system is turned on. When the vibrato switch 32a is turned on, vibratos are computed on the basis of the instantaneous count of the clock pulses.

Figure 7B:
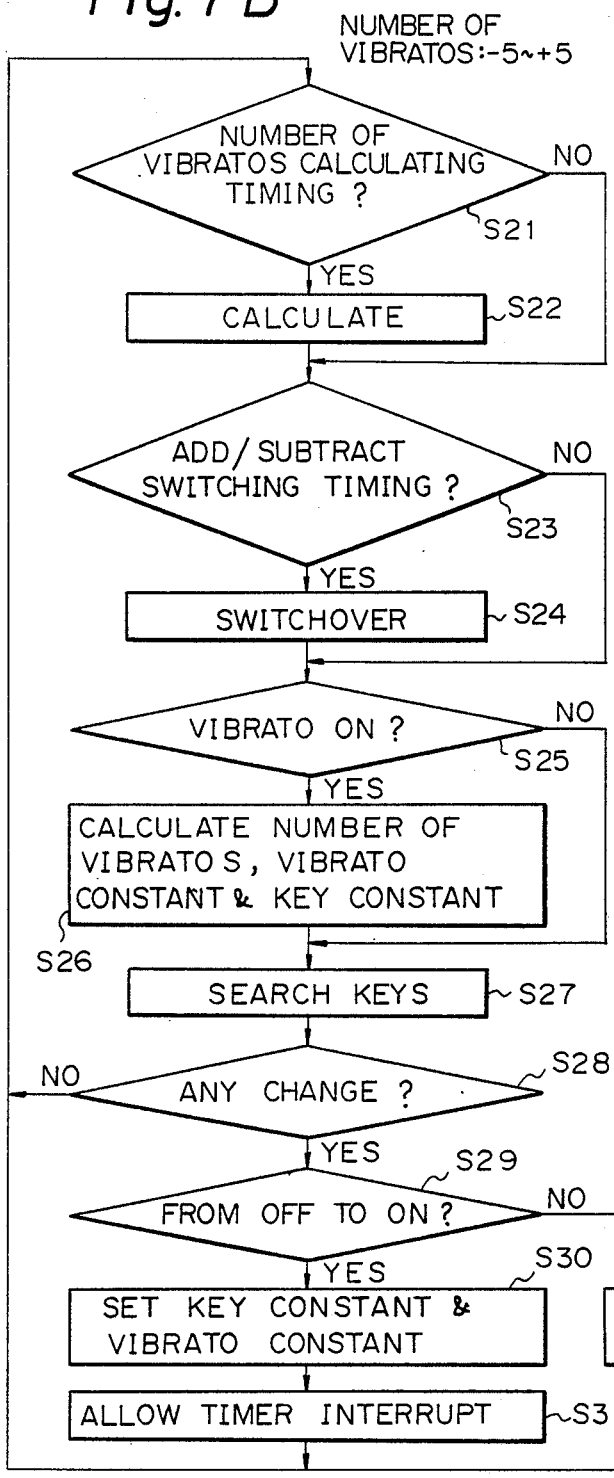
FIG. 7B is a flowchart demonstrating subroutines included in the main routine of FIG. 7A in detail.
Figure 7A:
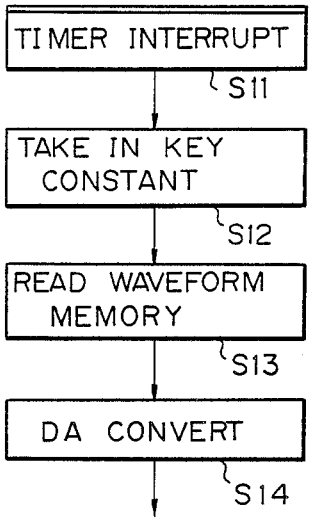
FIG. 7A is a flowchart representative of a main routine available with an alternative embodiment of the present invention for generating an address signal.

Referring to FIGS. 7A and 7B, a specific sequence of steps for generating address signals is shown which is representative of an alternative embodiment of the present invention. In FIG. 7A, data representative of a key constant K is taken in (step S12), and then waveform data S4 is read out of the tone waveform memory 46 of FIG. 3 (S13). Subsequently, the DA converter 48 converts the waveform data S4 into an analog signal S5 (S14).

The steps of waveform read-out and DA conversion (S13 and S14) stated above are shown in detail in FIG. 7B. Specifically, whether or not the timing for calculating the number of vibratos has been reached is determined (S21) and, if the answer is YES, and address signal is calculated (S22). This is followed by determining whether of not a timing for switching over the addition and subtraction has been reached (S23). If such a timing has been reached, the addition and subtraction of the vibrato constant V (f) are switched over (S24), as stated earlier with reference to FIG. 6. Then, the vibrato switch 32a is checked to see if it has been turned on (S25) and, if the answer is YES, and address is calculated by using the number of vibratos, vibrato constant V (f), and key constant K (S26). If the vibrato switch 32a is not turned on as decided in the step S25 or if the address is calculated in the step S26, the keys on the keyboard 32 are searched (S27) to see if any change has occurred in the key being pressed down (S28).

If the answer of the step S28 is negative, the program returns to the step S21 to repeat the same procedure. If the answer of the step S28 is positive, the program advances to a step S29 for determining whether the change occurred is from an OFF state to an ON state. If the change is from an OFF state to an ON state as decided in the step S29, a key constant K and a vibrato constant V (f) assigned to the key being depressed at that time are taken in (S30). Then, the program allows a timer interruption (S31) to occur and returns to the step S21. If the change is not from an OFF state to an ON state, i.e., if it is from an ON state to an OFF state, the timer interruption is inhibited (S32).

By repeating the sequence of steps described above, it is possible to effect vibratos with a tone associated with a key being depressed and in response to the operation of the vibrato switch 32a.

In summary, it will be seen that the present invention provides an electronic musical instrument which accomplishes a vibrato effect by use of a counter and a adder/subtractor which are extremely simple in construction. This enhances rapid processing even when computer control adopted and thereby allows even a small-scale microprocessor to implement the processing to cut down the overall cost of the instrument.

Various modifications will become possible for those skilled in the art after receiving the teachings of the present disclosure without departing from the scope thereof.

What is claimed is:

1. An electronic musical instrument capable of effecting vibratos with a tone being produced, comprising:

a keyboard having a vibrato switch;

key detecting means for detecting a key on said keyboard which is pressed down;

key constant storing means storing predetermined key constants each being associated with respective one of tones which may be produced by said instrument;

address signal generating means for generating an address signal by performing, every predetermined period of time, an arithmetic operation with the key constant associated with the key which is pressed;

tone waveform storing means storing amplitudes of a tone waveform each being associated with respective one of a plurality of sampling points, in the form of digital values;

digital-to-analog converting means for sequentially converting the digital amplitudes read out of said tone waveform storing means in response to the address signals into an analog tone signal;

counting means for counting clock pulses which begin to appear when a power supply of said instrument is turned on;

vibrato constant storing means storing vibrato constant each being associated with respective one of the keys on said keyboard; and adding and subtracting means for, when said vibrato switch is pressed, periodically performing addition and subtraction with the key constant and vibrato constant in response to an addition/subtraction switchover signal and an addition/subtraction execution control signal which are constituted by an output of said counting means.

* * * * *